US007226048B2

(12) United States Patent
Connors et al.

(10) Patent No.: US 7,226,048 B2
(45) Date of Patent: Jun. 5, 2007

(54) IMAGING APPARATUS HAVING A PRINT MEDIA DAM IN ASSOCIATION WITH AN AUTOMATIC SHEET FEEDER MECHANISM

(75) Inventors: William M Connors, Lexington, KY (US); Daniel R. Gagnon, Harrodsburg, KY (US); James M Jackson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 273 days.

(21) Appl. No.: 10/955,250

(22) Filed: Sep. 29, 2004

(65) Prior Publication Data

US 2006/0103067 A1 May 18, 2006

(51) Int. Cl.
*B65H 3/52* (2006.01)

(52) U.S. Cl. ..... 271/121; 271/124

(58) Field of Classification Search ..... 271/121, 271/124, 245, 122

See application file for complete search history.

(56) References Cited

U.S. PATENT DOCUMENTS 4,865,306 A 9/1989 Himegi
5,584,475 A 12/1996 Asada et al.
5,938,355 A 8/1999 Suzuki
6,199,855 B1 * 3/2001 Choeng et al. ..... 271/122
6,352,256 B1 3/2002 Hsieh
6,616,138 B2 9/2003 Tanaka
6,712,351 B2 3/2004 Hsieh
6,716,254 B2 4/2004 Takeuchi
6,896,253 B2 * 5/2005 Hanabusa ..... 271/117

* cited by examiner

*Primary Examiner*—Patrick Mackey
*Assistant Examiner*—Jeremy R Severson
(74) *Attorney, Agent, or Firm*—Taylor & Aust, P.C.

(57) ABSTRACT

An imaging apparatus includes a sheet picking mechanism drive unit that includes a sheet pick gear train for driving a sheet picking mechanism to transport a sheet from a stack of print media along the sheet feed path. A print media dam is pivotably coupled at an axis to the imaging apparatus. The print media dam has at least one dam member and a first gear. Each dam member has a media engaging surface. A drive mechanism is drivably coupled between the sheet picking drive mechanism and the first gear to move the dam member between an extended position and a retracted position. When the dam member is in the extended position, the media engaging surface is positioned to interrupt the sheet feed path. When the dam member is in the retracted position, the media engaging surface is positioned to not interrupt the sheet feed path.

8 Claims, 6 Drawing Sheets

IMAGING APPARATUS HAVING A PRINT MEDIA DAM IN ASSOCIATION WITH AN AUTOMATIC SHEET FEEDER MECHANISM

BACKGROUND OF THE INVENTION

1. Field of the Invention

The present invention relates to an imaging apparatus, and, more particularly, to an imaging apparatus having a print media dam in association with an automatic sheet feeder mechanism.

2. Description of the Related Art

An imaging apparatus typically includes an automatic sheet feeder (ASF) including a media tray and a sheet picking mechanism. The automatic sheet feeder automatically supplies a sheet of print media from a stack of print media positioned in the media tray to the print engine. During the loading of the media tray of the automatic sheet feeder, however, some of the print media may be pushed down into the automatic sheet feeder too far, resulting in simultaneous multiple sheet feeds, and may ultimately result in a media jam.

What is needed in the art is an imaging apparatus that reduces the occurrence of multiple media picks due to faulty loading of the automatic sheet feeder mechanism.

SUMMARY OF THE INVENTION

The present invention provides an imaging apparatus that reduces the occurrence of multiple media picks due to faulty loading of the automatic sheet feeder mechanism.

The present invention, in one form thereof, relates to an imaging apparatus having a sheet feed path. The imaging apparatus includes an automatic sheet feeder having a media tray for supporting a stack of print media, and a sheet picking mechanism for picking a sheet from the stack of print media. A sheet picking mechanism drive unit includes a sheet pick gear train for driving the sheet picking mechanism to transport the sheet from the stack of print media along the sheet feed path. A print media dam is pivotably coupled at an axis to the imaging apparatus. The print media dam has at least one dam member and a first gear. Each dam member has a media engaging surface. A drive mechanism is drivably coupled between the sheet picking drive mechanism and the first gear to move the dam member between an extended position and a retracted position. When the dam member is in the extended position, the media engaging surface is positioned to interrupt the sheet feed path. When the dam member is in the retracted position, the media engaging surface is positioned to not interrupt the sheet feed path.

In another form thereof, the present invention relates to a method for operating an imaging apparatus having a sheet feed path, and includes engaging a sheet pick gear train to pick a sheet from a stack of print media; when the sheet pick gear train is engaged, driving a pivoting print media dam to a retracted position to clear the sheet feed path; disengaging the sheet pick gear train such that no sheet of print media is being picked; and when the sheet pick gear train is disengaged, driving the pivoting print media dam to an extended position to interrupt the sheet feed path.

An advantage of the present invention is that it provides a positive stop that reduces the likelihood of the print media being pushed too far into the media tray.

Another advantage of the present invention is that it reduces the likelihood of simultaneous picking of multiple sheets of print media caused from pushing the print media too far into the media tray.

Still another advantage of the present invention is that it effects a straightening of the stack of print media each time the pivoting print media dam is returned to the extended position, e.g., each time the sheet pick gear train is disengaged.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an exemplary embodiment of the invention, and such exemplifications are not to be construed as limiting the scope of the invention in any manner.

DETAILED DESCRIPTION OF THE INVENTION

Figure 1:
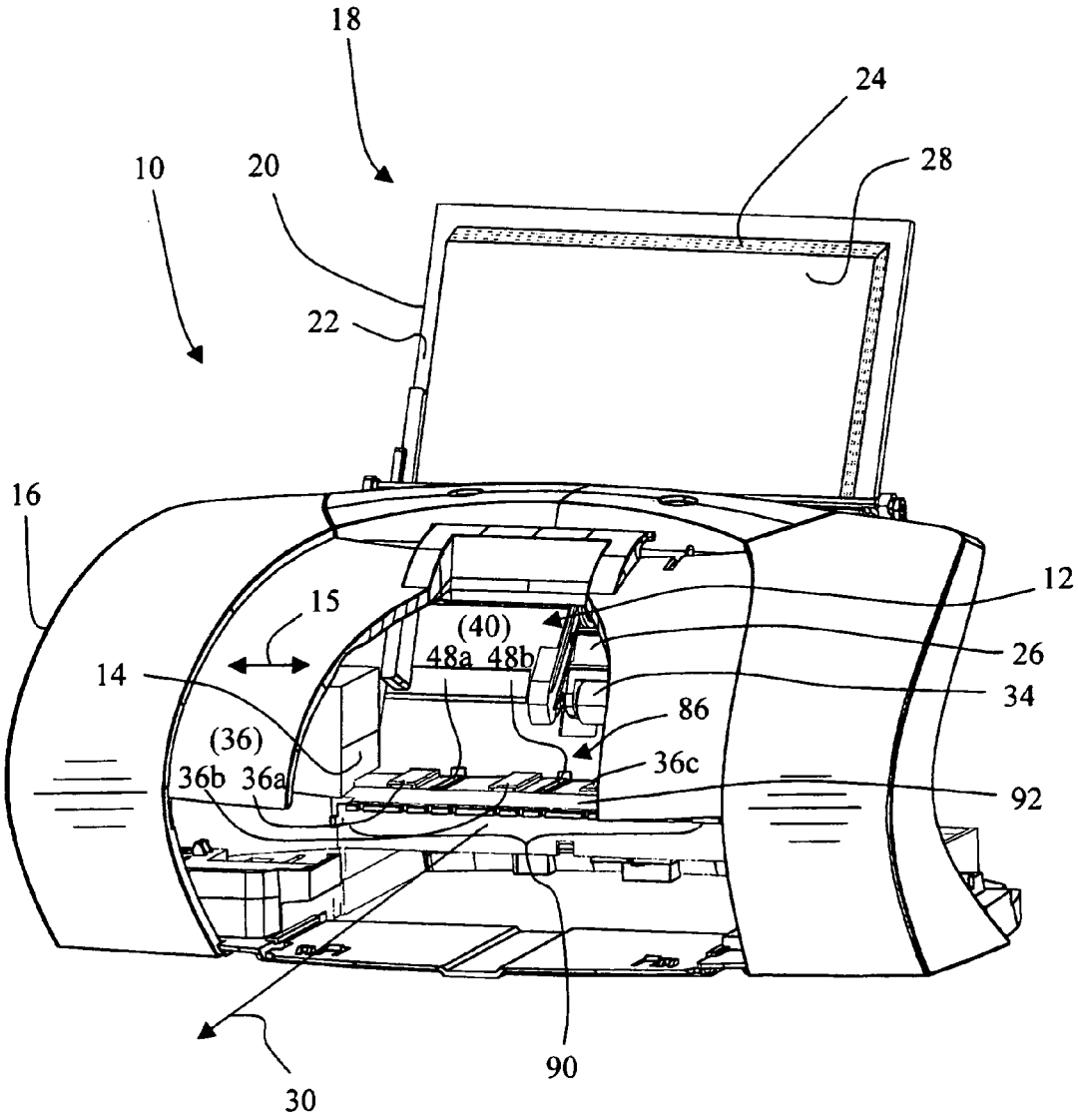
FIG. 1 is a perspective front view of an imaging apparatus in accordance with the present invention, with a portion of the housing cut away to show the pivoting print media dam in the retracted position.

Referring now to the drawings and particularly to FIGS. 1-4, there is shown an imaging apparatus 10 embodying the present invention.

Imaging apparatus 10 may be, for example, a printer or a multifunction unit. Such a multifunction unit may be configured to perform standalone functions, such as copying or facsimile receipt and transmission, in addition to printing. As shown, imaging apparatus 10 may include, for example, an ink jet print engine 12, which includes, for example, a reciprocating printhead carrier 14 which is transported along a bi-directional scan path 15.

Imaging apparatus 10 further includes a housing 16, and an automatic sheet feeder 18, a media tray 20 with a sheet support surface 22 for supporting a stack of print media 24, and a sheet picking mechanism 26.

Figure 3:
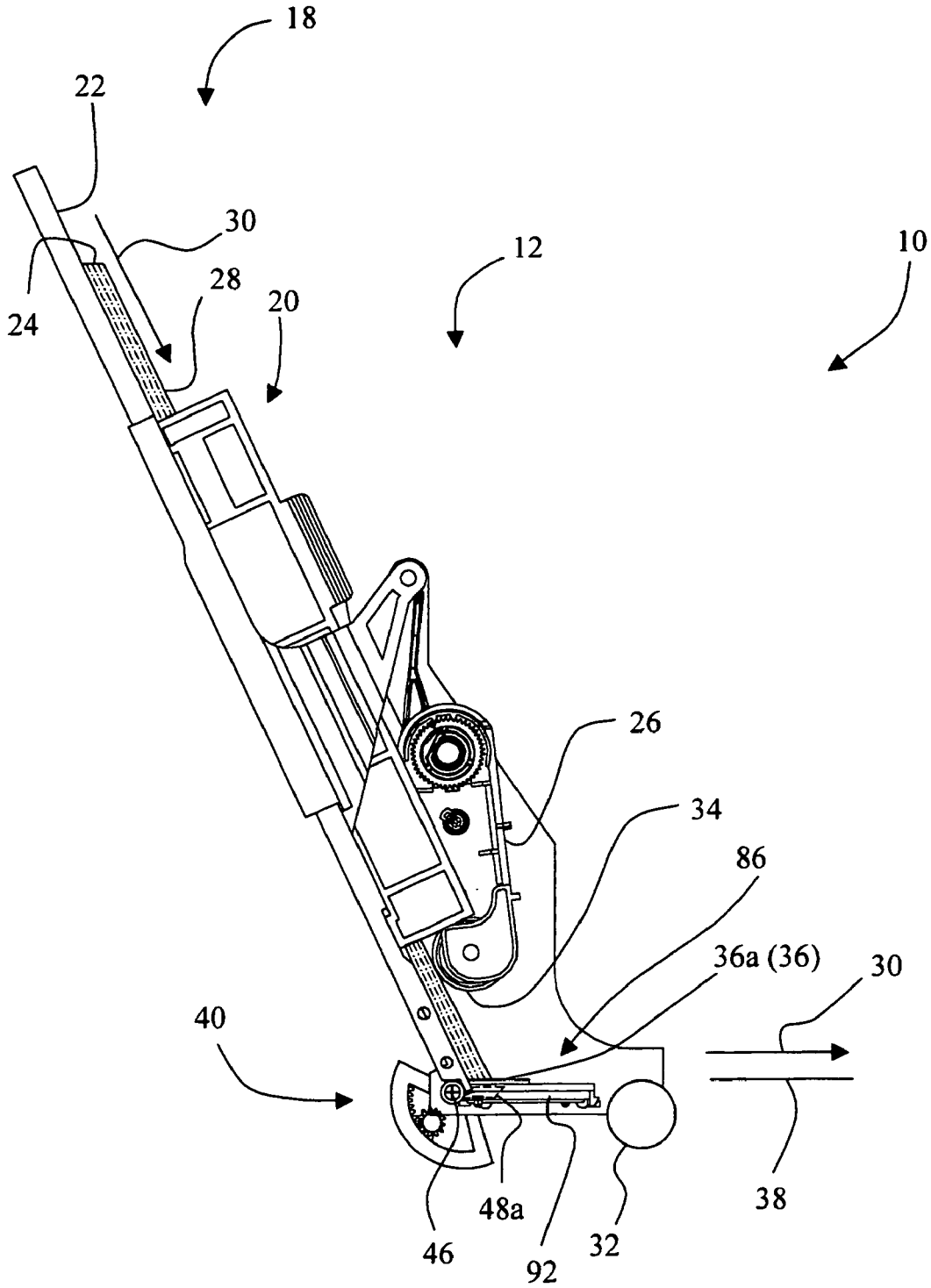
FIG. 3 is a side view of the imaging apparatus arrangement of FIG. 1, with the housing removed to show the dam members of the pivoting print media dam in the retracted position.
Figure 4:
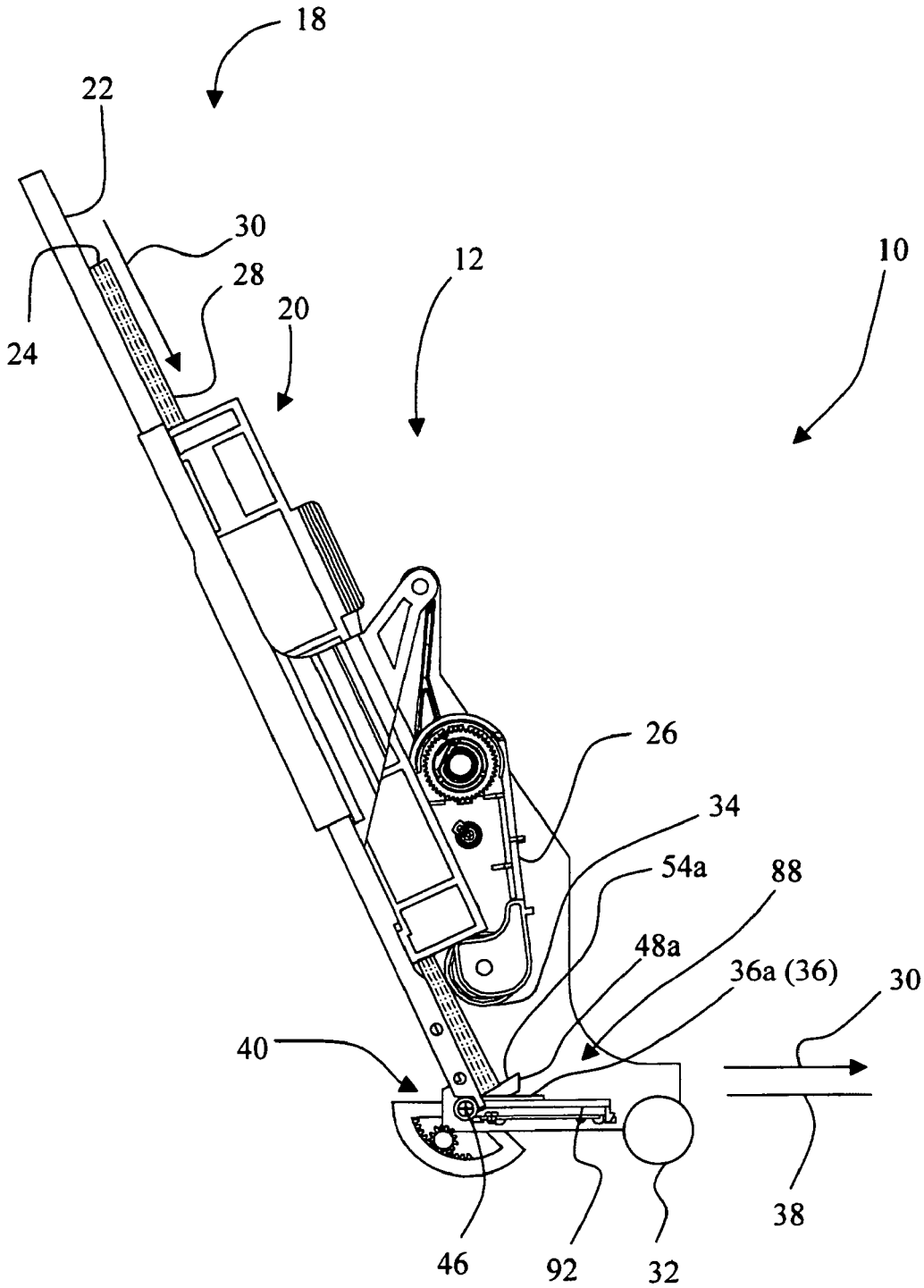
FIG. 4 is a side view of the imaging apparatus arrangement of FIG. 2, with the housing removed to show the dam members of the pivoting print media dam in the extended position.

Sheet picking mechanism 26 retrieves, i.e., picks, individual sheets from the stack of print media 24, and transports a sheet 28 along a sheet feed path 30 to a feed roller 32, shown in FIGS. 3 and 4. Sheet feed path 30 is substantially perpendicular to bi-directional scan path 15. More particularly, sheet picking mechanism 26 includes a sheet pick roller 34 configured to pick sheet 28 from the stack of print media 24 held in media tray 20. In the present embodiment, the sheet feed path has an L-shape; however, the principles of the present invention may be applied to other sheet feed path configurations, such as for example, a C-shaped media path.

Figure 2:
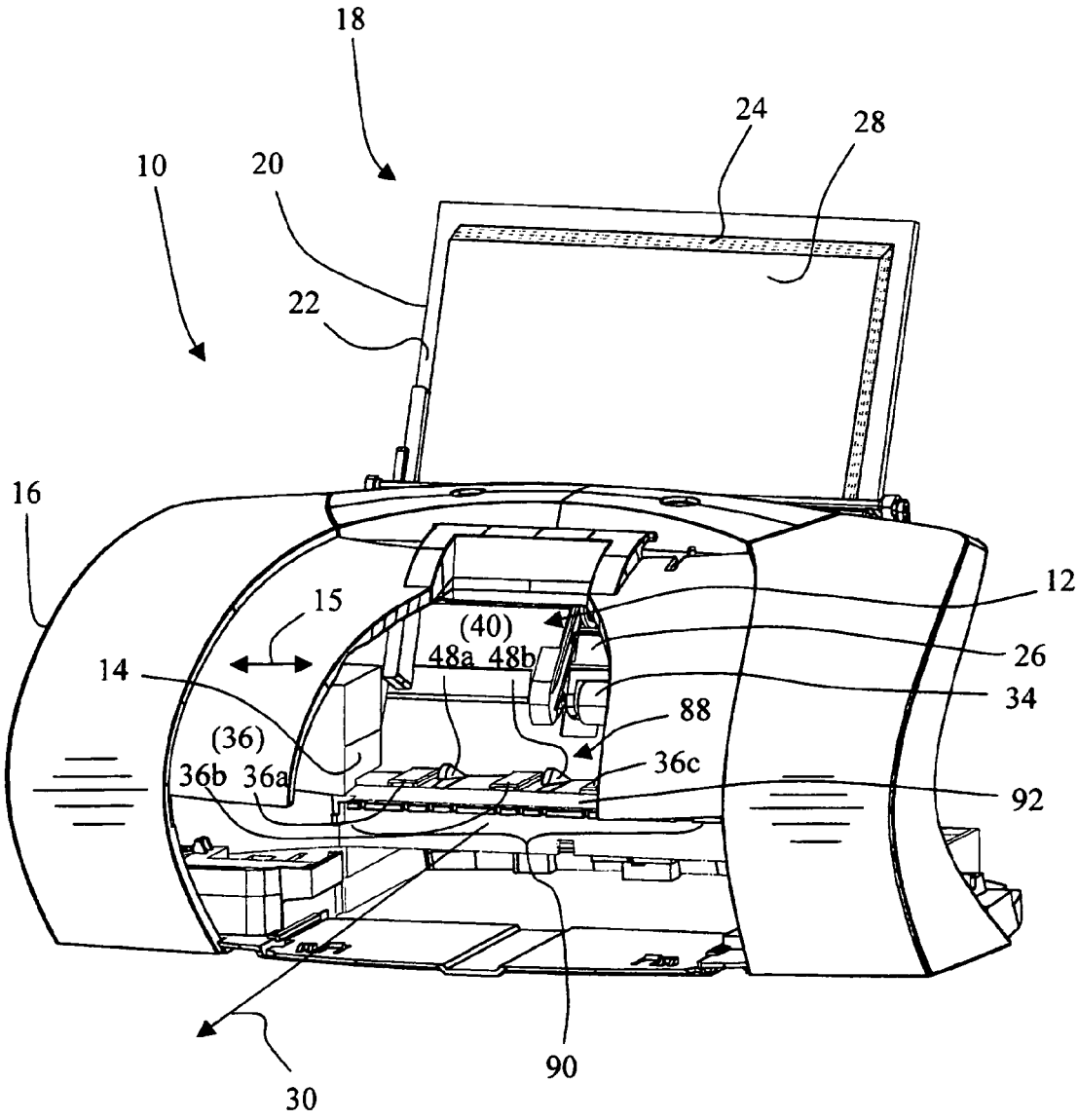
FIG. 2 is a perspective front view of the imaging apparatus of FIG. 1, showing the pivoting print media dam in the extended position.

As shown in FIGS. 1 and 2, a sheet separation surface 36, including individual sheet separation pads 36*a*, 36*b*, 36*c*, is positioned along sheet feed path 30 downstream from media tray 20 in the sheet feed direction indicated by the arrow on the line identifying sheet feed path 30. Sheet separation surface 36 is in a fixed position with respect to sheet feed path 30, i.e., sheet separation surface 36 is not moveable within, and with respect to, imaging apparatus 10. Sheet support surface 22 of media tray 20 is oriented to be inclined with respect to a substantially horizontal plane 38 (see FIGS. 3 and 4), i.e., with respect to sheet separation surface 36.

In the present embodiment, sheet separation surface 36, including individual sheet separating pads 36*a*, 36*b* and 36*c*, is formed by a plurality of elongated bars having high friction characteristics, each of which extends along substantially horizontal plane 38, and which collectively extend along bi-directional scan path 15. Accordingly, the friction generated between separation surface 36 and the stack of print media 24 when a top sheet 28 of the stack of print media 24 is engaged by sheet pick roller 34 tends to cause a single sheet of the stack of print media 24 to be picked.

Figure 5:
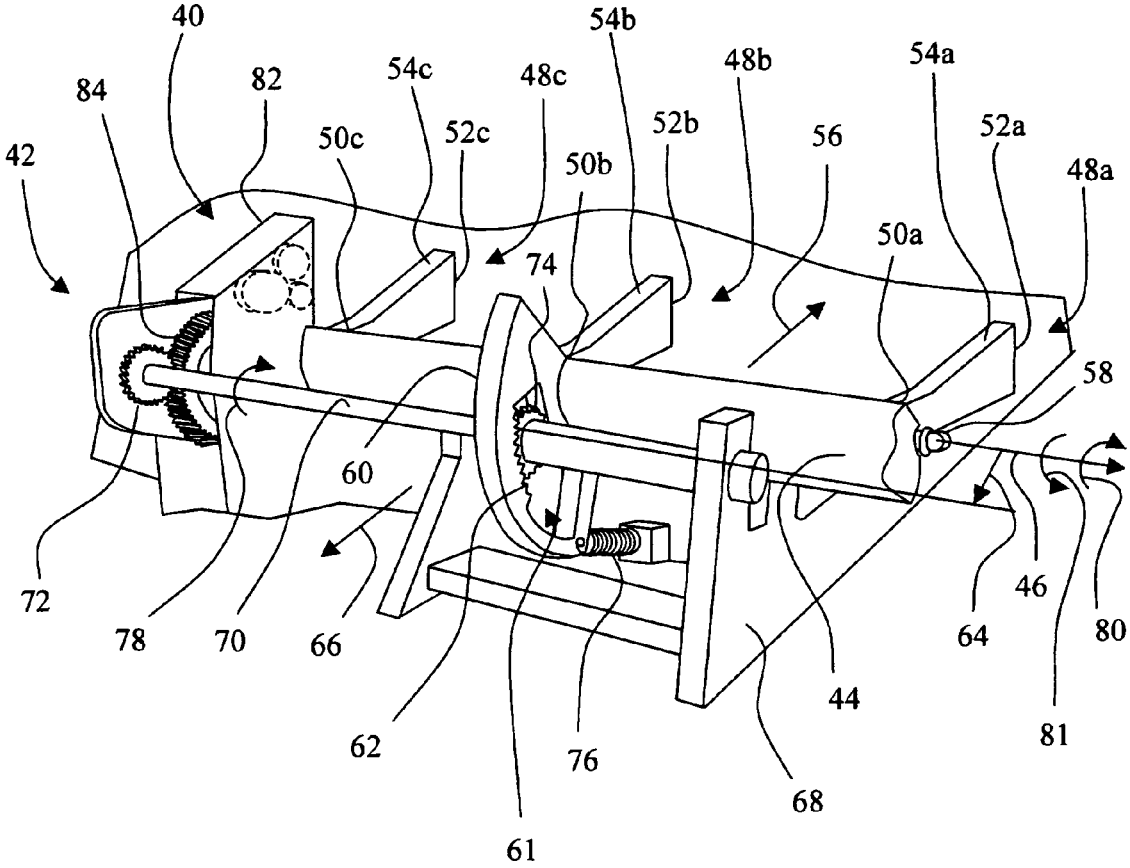
FIG. 5 is a perspective rear view of the pivoting print media dam and drive mechanism in accordance with the present invention.

FIG. 5 is a perspective rear view of a pivoting print media dam 40 and drive mechanism 42 configured in accordance with the present invention, and which is incorporated into imaging apparatus 10 as shown in FIGS. 1-4.

Pivoting print media dam 40 includes a central beam 44 that extends along an axis 46. Spaced at intervals along beam 44 is a plurality of dam members 48*a*, 48*b*, and 48*c*. Dam members 48*a*, 48*b*, 48*c* include proximal ends 50*a*, 50*b*, 50*c*; distal ends 52*a*, 52*b*, 52*c*; and media engaging surfaces 54*a*, 54*b*, 54*c*. Proximal ends 50*a*, 50*b*, 50*c* of dam members 48*a*, 48*b*, 48*c* are attached to beam 44. Dam members 48*a*, 48*b*, 48*c* extend from proximal ends 50*a*, 50*b*, 50*c* toward distal ends 52*a*, 52*b*, 52*c* in a direction 56 that is substantially perpendicular to axis 46.

Pivoting print media dam 40 may be pivotably coupled to imaging apparatus 10 via an axle 58, such as a rod or pins, positioned to correspond to axis 46, and which engages corresponding openings (not shown) in imaging apparatus 10. Pivoting print media dam 40 further includes an extension member 60 having an opening 61 which defines a curved internal gear rack 62. The curved internal gear rack 62 is formed at a radius 64 with respect to axis 46. In the embodiment shown, extension member 60 is attached to beam 44, and extends from beam 44 in a direction 66 generally opposite to the extent of dam members 48*a*, 48*b*, 48*c*.

Drive mechanism 42 includes a frame 68, a drive shaft 70, a drive gear 72, a drive gear 74, and spring 76. Drive shaft 70 is rotatably coupled to frame 68. Drive gears 72 and 74 are spaced apart and attached to drive shaft 70 for rotation therewith. Spring 76 is connected between frame 68 and extension member 60 of pivoting print media dam 40. Drive shaft 70 is positioned to extend through opening 61 of extension member 60, and drive gear 74 is positioned to mesh with the curved internal gear rack 62. Accordingly, when drive shaft 70 is rotated in rotation direction 78, e.g., clockwise as shown, then drive gear 74 sequentially engages the teeth of curved internal gear rack 62 to effect a corresponding pivot of pivoting print media dam 40 in rotation direction 80, e.g., also clockwise as shown. Spring 76 is extended as pivoting print media dam 40 pivots in rotation direction 80, and in turn applies a biasing force to extension member 60 to cause a reverse pivot of pivoting print media dam 40 in rotation direction 81 when drive shaft 70 is no longer driven.

A sheet pick gear train 82 drives sheet picking mechanism 26. Drive shaft 70 of drive mechanism 42 is also driven by sheet pick gear train 82 via at least one intermediate gear 84. Intermediate gear 84 is positioned to mesh with drive gear 72. Accordingly, when sheet pick gear train 82 is engaged so as to permit the picking of sheet 28 from the stack of print media 24, for example, the pivoting print media dam 40 is pivoted in rotation direction 80 to be in a retracted position 86, as shown in FIGS. 1 and 3, so as to clear, e.g., not interrupt, sheet feed path 30. However, when sheet pick gear train 82 is disengaged, then spring 76 will cause pivoting print media dam 40 to pivot in rotation direction 81 to an extended position 88, as shown in FIGS. 2 and 4, so as to interrupt sheet feed path 30, and to engage the stack of print media 24, when present.

Referring again to FIG. 5, media engaging surfaces 54*a*, 54*b*, 54*c* of dam members 48*a*, 48*b*, 48*c* may, for example, have a textured surface, e.g., a surface having raised bumps, for engaging a downstream end of the stack of print media 24 when pivoting print media dam 40 is in the extended position 88, so as to prevent the stack of print media 24 from slipping off of, or along, pivoting print media dam 40.

Referring also to FIGS. 1-4, dam members 48*a*, 48*b*, 48*c* of pivoting print media dam 40 are positioned and individually spaced along a width 90 of sheet feed path 30, and more particularly, along width 90 of mid-frame 92. Width 90 extends along bi-directional scan path 15. As shown in FIGS. 1 and 2, dam member 48*a* is positioned between sheet separation pads 36*a* and 36*b*, and dam member 48*b* is positioned between sheet separation pads 36*b* and 36*c*. While only three dam members 48*a*, 48*b*, 48*c*, and three sheet separation pads 36*a*, 36*b*, 36*c* of sheet separation surface 36 are shown and described with respect to the present embodiment, it is to be understood that this arrangement may be extended along the entirety of bi-directional scan path 15, if desired.

Further, while it may be preferred to include at least two dam members in implementing the present invention, it is contemplated that the present invention may be practiced using a single dam member, located centrally with respect to the leading edges, i.e., downstream end, of the stack of print media 24.

In summary, pivoting print media dam 40 is drivably moveable to pivot with respect to axis 46 between an extended position 88 (see FIGS. 2 and 4) and a retracted position 86 (see FIGS. 1 and 3). As shown, the extended position 88 is a raised position, and the retracted position 86 is a lowered position, with respect to sheet separation surface 36. Thus, pivoting print media dam 40 is movable within, and with respect to, imaging apparatus 10, and more particularly, is movable with respect to sheet feed path 30, while sheet separation surface 36 remains stationary with respect to sheet feed path 30.

Figure 6:
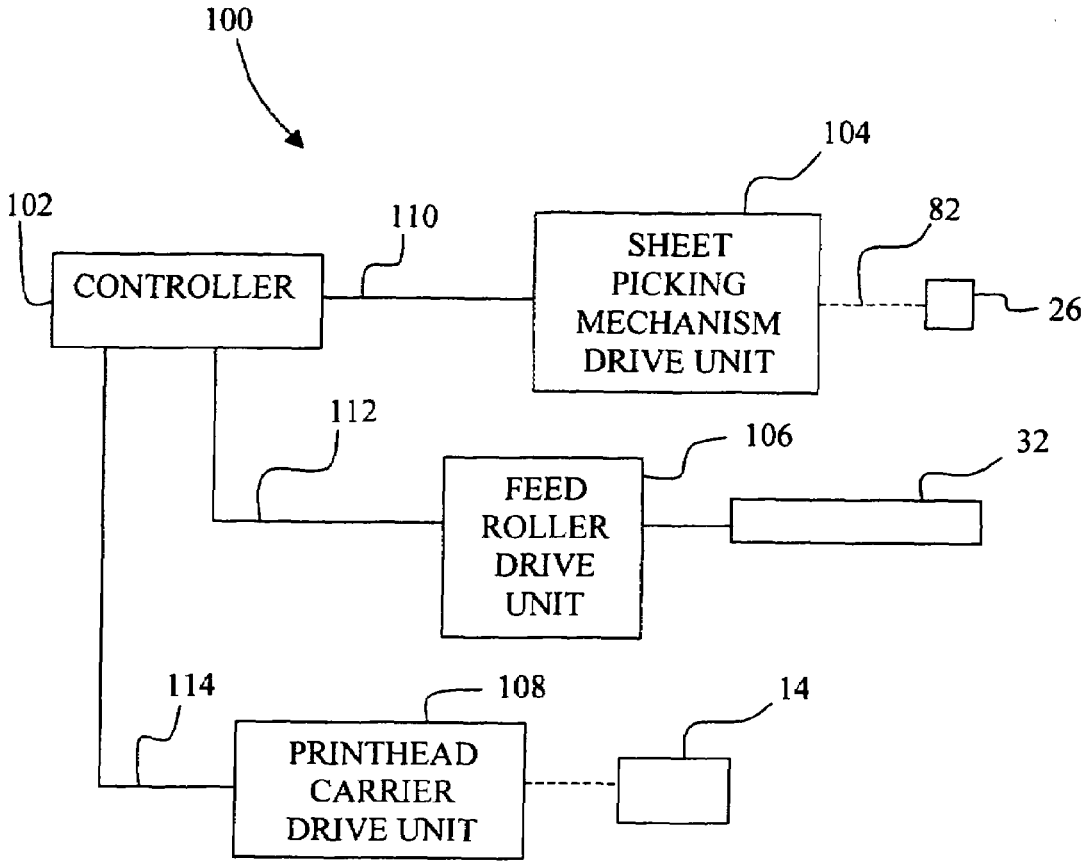
FIG. 6 is a block diagram of control circuitry for the imaging apparatus of FIG. 1.

Referring to FIG. 6, there is shown a simplified block diagram of control circuitry 100 associated with imaging apparatus 10. Control circuitry 100 includes a controller 102, a sheet picking mechanism drive unit 104 (including sheet pick gear train 82), a feed roller drive unit 106, and a printhead carrier drive unit 108. Each of the drive units 104, 106 and 108 may include a motor, such as for example, a direct current (DC) motor or a stepper motor. Alternatively, sheet picking mechanism drive unit 104 and feed roller drive unit 106 may share a common motor. Controller 102 is communicatively coupled to sheet picking mechanism drive unit 104 via a communications link 110. Controller 102 is communicatively coupled to feed roller drive unit 106 via a communications link 112. Controller 102 is communicatively coupled to printhead carrier drive unit 108 via a communications link 114. As used herein, the term "communications link" is used to generally refer to structure that facilitates electronic communication between two components, and may operate using wired or wireless technology. Thus, communications links 110, 112, and 114 may be, for example, a wired connection, or may be a wireless link.

Controller 102 may be formed as an application specific integrated circuit (ASIC), and includes processing capability, which may be in the form of a microprocessor having an associated random access memory (RAM) and read only memory (ROM). Controller 102 executes program instructions to effect the picking of sheet 28 from the stack of print media 24, the transporting of sheet 28 along sheet feed path 30, and the printing of an image on sheet 28.

During operation, referring also to FIGS. 1-5, controller 102 supplies a command to sheet picking mechanism drive unit 104 to pick a sheet 28 from the stack of print media 24. In turn, sheet picking mechanism drive unit 104 activates sheet picking mechanism 26 via sheet pick gear train 82, which responds by rotating sheet pick roller 34. Controller 102 further commands feed roller drive unit 106 to rotate feed roller 32 by a predetermined index feed distance to convey sheet 28 along the sheet feed path 30. During printing, controller 102 provides commands to printhead carrier drive unit 108, which in turn effects a reciprocation of printhead carrier 14 across the width of sheet 28.

When sheet pick gear train 82 is engaged, i.e., sheet 28 is picked from stack of print media 24, then pivoting print media dam 40 is driven by the rotation of drive shaft 70 to the retracted position 86, and accordingly, the media engaging surfaces 54*a*, 54*b*, 54*c* of pivoting print media dam 40 are parallel to and slightly lower than sheet separation surface 36 (see FIGS. 1 and 3). Thus, the sheet 28 picked by sheet picking roller 34 can be delivered to feed roller 32, which in turn further transports sheet 28 along sheet feed path 30 and past the reciprocating printhead carrier 14. The term "parallel" is intended to include small deviations from actual parallel.

When sheet pick gear train 82 is disengaged, i.e., no sheet of print media is being picked, spring 76 drives the pivoting print media dam 40 to the extended position 88, wherein the media engaging surfaces 54*a*, 54*b*, 54*c* of pivoting print media dam 40 are non-parallel to sheet separation surface 36, and more particularly, are substantially perpendicular to sheet support surface 22 of media tray 20 (see FIGS. 2 and 4). By the term "non-parallel", it is meant a significant deviation from actual parallel. Thus, when pivoting print media dam 40 is in the extended position 88, pivoting print media dam 40 provides a positive stop for engaging a downstream end of the stack of print media 24, such as during the loading of the stack of print media 24 into the media tray 20 of automatic sheet feeder 18. Further, when pivoting print media dam 40 is in extended position 88, pivoting print media dam 40 provides a positive stop for preventing a sheet, such as sheet 28, from being delivered to feed roller 32.

Accordingly, the configuration of the present invention advantageously will effect a straightening of the stack of print media 24 each time pivoting print media dam 40 is returned to the extended position 88, e.g., each time sheet pick gear train 82 is disengaged.

While this invention has been described with respect to an exemplary embodiment, the present invention may be further modified within the spirit and scope of this application. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus having a sheet feed path, comprising:

an automatic sheet feeder having a media tray for supporting a stack of print media, and a sheet picking mechanism for picking a sheet from said stack of print media;

a sheet picking mechanism drive unit including a sheet pick gear train for driving said sheet picking mechanism to transport said sheet from said stack of print media along said sheet feed path;

a print media dam pivotably coupled at an axis to said imaging apparatus, said print media dam being formed by:

an elongate beam extending along said axis, at least one dam member extending radially outwardly from said elongate beam, each said dam member having a media engaging surface, and an extension member extending radially outwardly from said elongate beam, said extension member including teeth forming a first gear; and a drive mechanism drivably coupled between said sheet picking drive mechanism and said first gear to move said at least one dam member between an extended position and a retracted position, wherein when said at least one dam member is in said extended position, said media engaging surface is positioned to interrupt said sheet feed path, and when said at least one dam member is in said retracted position, said media engaging surface is positioned to not interrupt said sheet feed path, wherein said extension member is located in a central region of said elongate beam along said axis, and said first gear is a curved gear rack.

2. An imaging apparatus having a sheet feed path, comprising:

an automatic sheet feeder having a media tray for supporting a stack of print media, and a sheet picking mechanism for picking a sheet from said stack of print media;

a sheet picking mechanism drive unit including a sheet pick gear train for driving said sheet picking mechanism to transport said sheet from said stack of print media along said sheet feed path;

a print media dam pivotably coupled at an axis to said imaging apparatus, said print media dam being formed by:

an elongate beam extending along said axis, at least one dam member extending radially outwardly from said elongate beam, each said dam member having a media engaging surface, and an extension member extending radially outwardly from said elongate beam, said extension member including teeth forming a first gear; and a drive mechanism drivably coupled between said sheet picking drive mechanism and said first gear to move said at least one dam member between an extended position and a retracted position, wherein when said at least one dam member is in said extended position, said media engaging surface is positioned to interrupt said sheet feed path, and when said at least one dam member is in said retracted position, said media engaging surface is positioned to not interrupt said sheet feed path, said extension member extending from a central region of said elongate beam in a direction generally opposite to an extent of said at least one dam member.

3. An imaging apparatus having a sheet feed path, comprising:

an automatic sheet feeder having a media tray for supporting a stack of print media, and a sheet picking mechanism for picking a sheet from said stack of print media;

a sheet picking mechanism drive unit including a sheet pick gear train for driving said sheet picking mechanism to transport said sheet from said stack of print media along said sheet feed path;

a print media dam pivotably coupled at an axis to said imaging apparatus, said print media dam being formed by:

an elongate beam extending along said axis, at least one dam member extending radially outwardly from said elongate beam, each said dam member having a media engaging surface, and an extension member extending radially outwardly from said elongate beam, said extension member including teeth forming a first gear; and a drive mechanism drivably coupled between said sheet picking drive mechanism and said first gear to move said at least one dam member between an extended position and a retracted position, wherein when said at least one dam member is in said extended position, said media engaging surface is positioned to interrupt said sheet feed path, and when said at least one dam member is in said retracted position, said media engaging surface is positioned to not interrupt said sheet feed path, said extension member having an opening which defines said first gear.

4. The imaging apparatus of claim 3, wherein said first gear is a curved internal gear rack, said curved internal gear rack being formed at a radius with respect to said axis.

5. The imaging apparatus of claim 4, said drive mechanism comprising:

a frame;

a drive shaft rotatably coupled to said frame;

a second gear attached to said drive shaft; and a third gear attached to said drive shaft and spaced from said second gear, said drive shaft being positioned to extend through said opening of said extension member, and said third gear being positioned to mesh with said curved internal gear rack.

6. The imaging apparatus of claim 5, further comprising at least one intermediate gear drivably coupling said sheet pick gear train to said second gear.

7. The imaging apparatus of claim 5, wherein when drive shaft is rotated in a first rotation direction, then said third gear sequentially engages teeth of said curved internal gear rack to effect a corresponding pivot of said print media dam in a corresponding rotation direction.

8. The imaging apparatus of claim 7, said drive mechanism further comprising a spring attached to said extension member, said spring applying a biasing force to said extension member to cause a reverse pivot of said print media dam in a rotation direction opposite to said corresponding rotation direction when said drive shaft is no longer driven.

* * * * *